United States Patent [19]

Niemerg

[11] Patent Number: 4,645,485

[45] Date of Patent: Feb. 24, 1987

[54] CONTROL VALVE FOR SELF-EMPTYING CENTRIFUGE DRUM

[75] Inventor: Willi Niemerg, Oelde, Fed. Rep. of Germany

[73] Assignee: Westfalia Separator AG, Oelde, Fed. Rep. of Germany

[21] Appl. No.: 802,483

[22] Filed: Nov. 27, 1985

[30] Foreign Application Priority Data

Dec. 1, 1984 [DE] Fed. Rep. of Germany ..... 3443955

[51] Int. Cl.[4] ..... B04B 11/04

[52] U.S. Cl. ..... 494/27; 251/20; 494/56

[58] Field of Search ..... 251/20, 22; 494/27, 494/40, 56

[56] References Cited

U.S. PATENT DOCUMENTS 3,099,282 7/1963 Miller ..... 251/20 X
3,940,056 2/1976 Schmidt ..... 494/27
3,985,292 10/1976 Schmidt ..... 494/27

FOREIGN PATENT DOCUMENTS 2938628 3/1981 Fed. Rep. of Germany ..... 494/56

*Primary Examiner*—Robert G. Nilson
*Attorney, Agent, or Firm*—Sprung Horn Kramer & Woods

[57] ABSTRACT

A control valve for a self-emptying centrifuge drum for draining closure fluid out of a closure chamber positioned below an axially movable piston slide with a valve piston that closes the closure-fluid runoff bores by means of centrifugal force and opens them by supplying control fluid to an initial control chamber that has an inlet and an outlet. To improve the known control valve to the extent that it will close more rapidly, making the amount of solids extracted at each emptying more constant, another control chamber, also having an inlet and an outlet, but in which the active face of the piston is larger than that of the piston in the initial control chamber, is provided, with the volumes of the control chambers and the cross-sections of the inlets and outlet ensuring that the initial control chamber is filled first and the second control chamber only after a delay.

6 Claims, 5 Drawing Figures

CONTROL VALVE FOR SELF-EMPTYING CENTRIFUGE DRUM

BACKGROUND OF THE INVENTION

The present invention relates to a control valve for a self-emptying centrifuge drum for draining closure fluid out of a closure chamber positioned below an axially movable piston slide with a valve piston that closes the closure-fluid runoff bores by means of centrifugal force and opens them by supplying control fluid to an initial control chamber that has an inlet and an outlet.

A control valve of this type is known, for example, from German Utility Model No. 7 306 879. Emptying the centrifuge drum is initiated by supplying control fluid to the control chamber through a control-water channel. The high fluid pressure produced by centrifugal force acts on the associated face of the valve piston and generates a force that is greater than the centrifugal force acting on the piston, moving it toward the center of the drum. This releases the closure-chamber runoff bores, the chamber empties, and the piston slide descends axially. To terminate the emptying process and close the piston slide it is necessary to stop supplying control water, upon which the control chamber empties through an outlet, the valve piston closes off the runoff bores again, and the piston-slide closure chamber fills up again.

Self-emptying centrifuge drums are preferably only partly emptied in order to optimize operations. To ensure unobjectionable removal of even heavy solids, the piston slide must stroke as far as possible. This is only possible, however, if the control valve operates very rapidly. Although the known valves open rapidly enough when the control-fluid supply is ample, closure depends on emptying the control chamber, which takes longer. The amount of solids extracted during each partial emptying should also be as constant as possible in order to minimize product loss and obtain compact solids. Since the time it takes to open and to close the slide piston with . . . the known control valve depends on how much closure fluid is supplied to the control valve and on how rapidly, it is often impossible to keep this figure constant.

SUMMARY OF THE INVENTION

The object of the present invention is to improve the known control valve to the extent that it will close more rapidly, making the amount of solids extracted at each emptying more constant.

This object is attained in accordance with the invention by providing another control chamber, also having an inlet and an outlet, but in which the active face of the piston is larger than that of the piston in the initial control chamber, with the volumes of the control chambers and the cross-sections of the inlets and outlet ensuring that the initial control chamber is filled first and the second control chamber only after a delay.

The second control chamber makes it possible to begin closing the control valve even when the total control-fluid pressure still prevails in the initial control chamber. The chronology of opening and closing is accordingly determined by the prescribed volumes of both control chambers and by the cross-sections of the inlets and outlets, with closure fluid supplied to both chambers simultaneously. Closure accordingly becomes independent of how long the closure fluid is supplied as soon as the second control chamber is full of fluid.

How long it takes to open the control valve depends in one embodiment of the invention on the volume of the second control chamber being greater than the volume of the initial control chamber, with the cross-sections of the inlets and outlets being constant. Opening time can accordingly be calculated from the difference between how long it takes to fill each control chamber. It is, however, also possible to make the cross-sections of the inlets and outlets different, with the control chambers having equal or different volumes.

It is extremely simple to ensure that the control chambers are uniformly supplied with control fluid if the inlets into the control chambers communicate through one control-fluid channel.

The outlet from the initial control chamber in one preferred embodiment of the invention empties into the second control chamber and has a larger cross-section than the outlet from the second control chamber. In this embodiment the initial control chamber will fill up first and open the piston valve. The second control chamber will also fill up through the outlet from the initial control chamber, with the filling time dependent on the cross-sections of both outlets and on the volume of the second control chamber. As soon as the second control chamber is full, the largerface on its piston will cause the control valve to close.

Closure can be accelerated even more if the second control chamber accommodates an auxiliary piston that is forced by centrifugal force against the face of the valve piston, which is provided with a buffer chamber, closing channels that are accommodated in the piston and that the two control chambers communicate through. Thus, only the buffer chamber will fill up initially, through the outlet from the initial control chamber. Once the buffer chamber is full, the auxiliary piston will lift off of the piston face and open the communicating channels between the control chambers. The second control chamber will now fill up in spurts and instantaneously close the valve piston.

Some preferred embodiments of the invention will now be described with reference to the attached drawings, wherein:

DETAILED DESCRIPTION OF THE PREFERRED EMBODIMENTS

Figure 1:
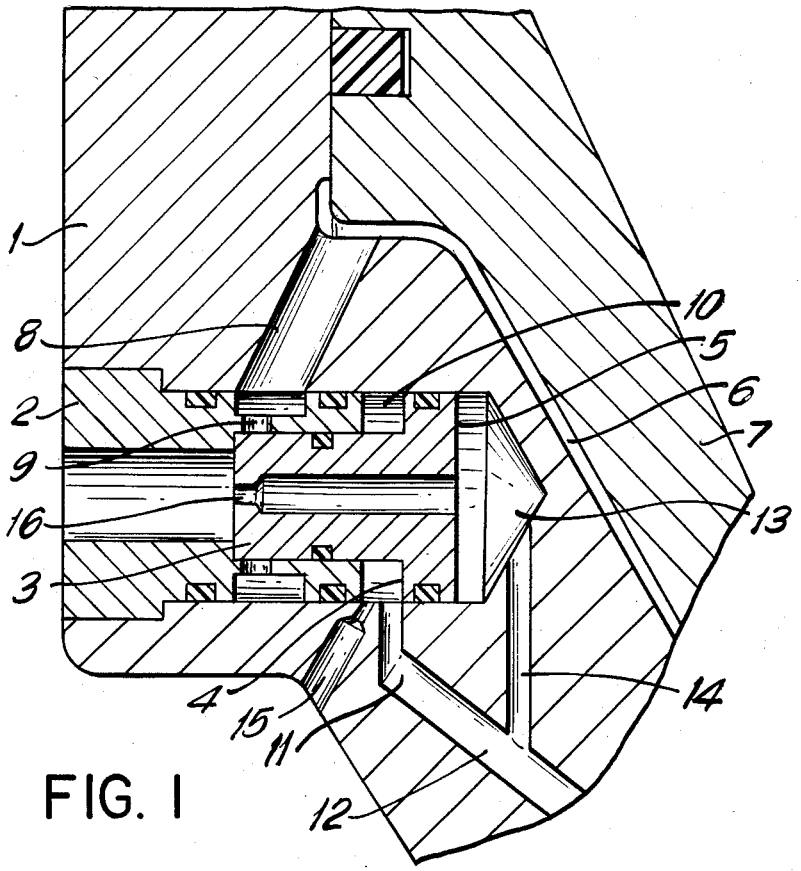
FIG. 1 is a section through a control valve in accordance with the invention with separate inlets into the control chambers.

A valve housing 2 and a valve piston 3 with different-size piston faces 4 and 5 is radially accommodated in the bottom 1 of a centrifuge drum in FIG. 1. An emptying channel 8 leads from a closure chamber 6 below a piston slide 7 to runoff bores 9 in valve housing 2. Runoff bores 9 are closed off by valve piston 3. Between valve housing 2 and valve piston 3 is an initial control chamber 10 that communicates with a control-fluid channel 12 through a inlet 11. Another control chamber 13 associated with valve piston 3 also communicates with control-fluid channel 12 through an inlet 14. Control chambers 10 and 13 also have closure-fluid outlets 15 and 16.

When the centrifuge drum is in operation, valve piston 3 initially closes runoff bores 9, and piston slide 7 is kept closed by the fluid pressure prevailing in closure chamber 6. To empty the drum, control-fluid channel 12 is filled up completely from a control-fluid supply device that is not illustrated and both control chambers 10 and 13 are filled with control fluid. Initial control chamber 10 fills up first because of its essentially smaller volume and opens valve piston 3. Once second control chamber 13 fills up, closure is immediately initiated because, when the fluid pressure is constant, the force acting on piston face 5 will be essentially higher than that acting on piston face 4. Runoff bores 9 will accordingly remain open for exactly as long every time the drum is emptied because one control chamber will take longer to fill up than the other, and the same amount of closure fluid will accordingly flow out of closure chamber 6, meaning that the amount of solids extracted will always be exactly the same. Only after valve piston 3 closes will the supply of control fluid be interrupted and both control chambers empty through their respective outlets 15 and 16.

Figure 2:
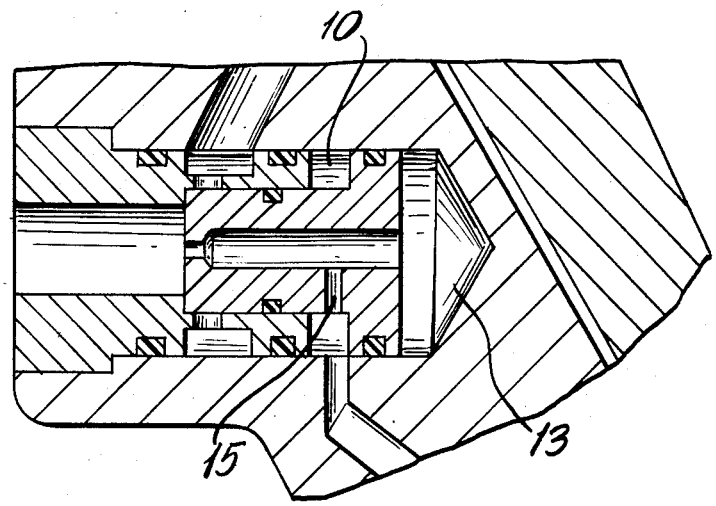
FIG. 2 is a section through a control valve in accordance with the invention in which the outlet from the initial control chamber communicates with the second control chamber.

The initial control chamber 10 in the embodiment illustrated in FIG. 2 must be completely full before a significant amount of fluid can be supplied to second control chamber 13 through outlet 15. This makes the chronology of filling both control chambers even more precise. Second control chamber 13 can also be smaller if control fluid is not supplied to both control chambers simultaneously.

Figure 3:
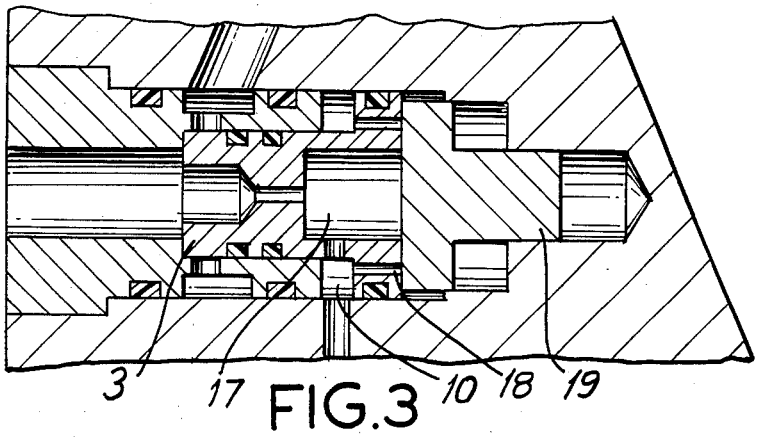
FIG. 3 illustrates a control valve in accordance with the invention with an auxiliary piston upstream of where the control fluid is introduced in the second control chamber.
Figure 4:
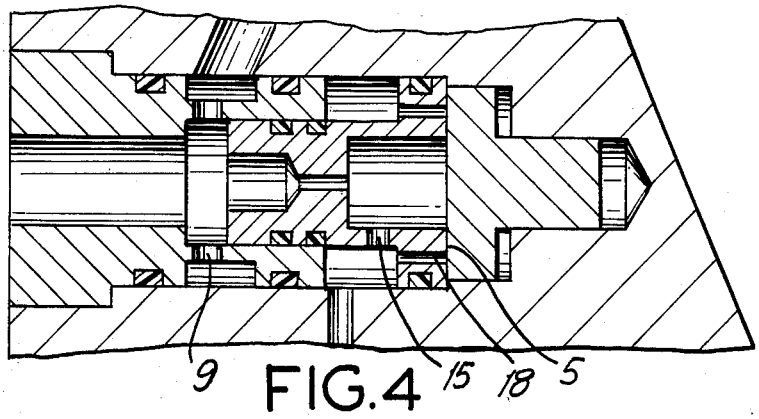
FIG. 4 illustrates the control valve from FIG. 3 in the open state subsequent to the introduction of control fluid.
Figure 5:
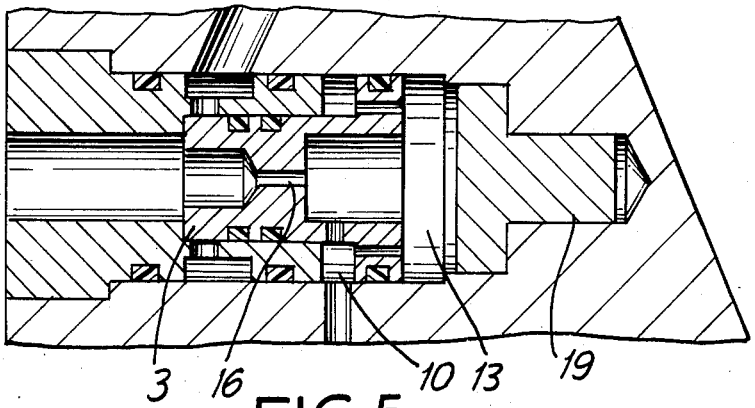
FIG. 5 illustrates the control valve from FIG. 3 immediately after closing.

The embodiment illustrated in FIG. 3 accelerates closure even more. Valve piston 3 has a buffer chamber 17 and communicating channels 18, which are initially closed off by an auxiliary piston 19 in second control chamber 13. Once initial control chamber 10 is full, valve piston 3 moves along with auxiliary piston 19 into the position illustrated in FIG. 4, opening runoff bores 9, and buffer chamber 17 simultaneously fills up from outlet 15. As soon as buffer chamber 17 is full, the fluid pressure prevailing in buffer chamber 17 lifts auxiliary piston 19 off of piston face 5 and releases communicating channels 18, accelerating both the filling up of second control chamber 13 and the closure of valve piston 3. Control chambers 10 and 13 now empty through outlet 16. The position of auxiliary piston 19 while the closure-fluid pressure is still present and with valve piston 3 already closed will be evident from FIG. 5.

It will be appreciated that the instant specification and claims are set forth by way of illustration and not limitation, and that various modifications and changes may be made without departing from the spirit and scope of the present invention.

What is claimed is:

1. In a self-emptying centrifuge drum having an axially movable piston slide for opening and closing the drum, a closure chamber below the piston slide and receptive of closure fluid for closing the drum, a control valve for draining closure fluid out of the closure chamber to open the drum, the control valve including a first control chamber having an inlet receptive of a control fluid and a valve piston movable in response to the application of control fluid to the first chamber from a closing position wherein runoff bores from the closure chamber are blocked to an opening position wherein the runoff bores are unblocked to effect the draining of closure fluid from the closure chamber, the improvement wherein the control valve further comprises means responsive to the continued application of control fluid to the first chamber for moving the valve piston from the opening position to the closing position after a selected time delay.

2. The control valve according to claim 1, wherein the means comprises a second control chamber having an inlet receptive of the control fluid and an outlet, wherein the piston has a first active face in the first control chamber and a second active face in the second control chamber which is larger than the first active face in the first control chamber, and wherein the volumes of the control chambers and the cross-sections of the inlets and outlet thereof are selected to effect the filling of the first control chamber first and the filling of the second control chamber after said time delay.

3. The control valve as in claim 2, wherein the first and second chambers have inlet and outlets and the volume of the second control chamber is greater than the volume of the first control chamber and wherein the cross-sections of the inlets and outlets are equal.

4. The control valves as in claim 2, wherein the inlets into the control chambers communicate through single control-fluid channel.

5. The control valve as in claim 2, wherein the outlet from the first control chamber empties into the second control chamber and has a larger cross-section than the outlet from the second control chamber.

6. The control as in claim 2, wherein the second control chamber has an axially piston therein that is forced by centrifugal force against the second active face having a buffer chamber therein and wherein the valve piston has closing channels therein and through which the two control chambers communicate.

* * * * *